US010677566B2

(12) United States Patent
Dantzer et al.

(10) Patent No.: US 10,677,566 B2
(45) Date of Patent: Jun. 9, 2020

(54) BLAST PANEL ASSEMBLY

(71) Applicants: Hugh Alexander Dantzer, Edmonton (CA); Khaled Aly El-Domiaty, Washington, DC (US)

(72) Inventors: Hugh Alexander Dantzer, Edmonton (CA); Khaled Aly El-Domiaty, Washington, DC (US)

(73) Assignee: Stone Protective Solutions, LLC, Callicoon, NY (US)

( * ) Notice: Subject to any disclaimer, the term of this patent is extended or adjusted under 35 U.S.C. 154(b) by 0 days.

(21) Appl. No.: 15/530,197

(22) Filed: Dec. 13, 2016

(65) Prior Publication Data

US 2018/0163401 A1 Jun. 14, 2018

(51) Int. Cl.

| | |
|---|---|
| ***F41H 5/04*** | (2006.01) |
| ***E04C 2/24*** | (2006.01) |
| ***E04C 2/38*** | (2006.01) |
| ***E04C 2/12*** | (2006.01) |

(52) U.S. Cl.

CPC ..... *F41H 5/04* (2013.01); *E04C 2/12* (2013.01); *E04C 2/24* (2013.01); *E04C 2/384* (2013.01)

(58) Field of Classification Search

CPC ... F41H 5/00; F41H 5/013; F41H 5/02; F41H 5/0492; F41H 5/0471; F41H 5/04; F41H 5/06; B32B 21/00; B32B 21/02; B32B 21/04; B32B 21/042; B32B 21/13; E04C 2/24; E04C 2/12; E04C 2/384

See application file for complete search history.

(56) References Cited

U.S. PATENT DOCUMENTS

| | | | | | |
|---|---|---|---|---|---|
| 2,303,003 | A * | 11/1942 | Rumsey | E04B 1/99 | 156/212 |
| 2,332,732 | A * | 10/1943 | Laucks | E04B 2/42 | 52/210 |
| 3,051,260 | A * | 8/1962 | Eckel | E06B 5/20 | 181/287 |
| 3,970,497 | A * | 7/1976 | Glover | B27D 1/04 | 144/352 |
| 4,033,243 | A * | 7/1977 | Kirrish | F16B 37/145 | 411/338 |
| 4,310,273 | A * | 1/1982 | Kirrish | F16B 5/0233 | 411/338 |
| 5,968,625 | A * | 10/1999 | Hudson | B32B 21/13 | 428/106 |
| 6,162,312 | A * | 12/2000 | Abney | B27D 1/04 | 144/346 |
| 6,256,960 | B1 * | 7/2001 | Babcock | E04B 1/14 | 52/281 |
| 6,298,619 | B1 * | 10/2001 | Davie | E04B 1/14 | 52/220.7 |
| 8,161,697 | B1 * | 4/2012 | McDonald | E04C 2/16 | 428/106 |
| 8,407,965 | B2 * | 4/2013 | Dorozhkin | B27M 3/0046 | 144/353 |

(Continued)

FOREIGN PATENT DOCUMENTS

| | | | | |
|---|---|---|---|---|
| DE | 2856085 A1 * | 6/1980 | F41H 5/04 |
| WO | WO 2006011741 A1 * | 2/2006 | B32B 3/02 |

*Primary Examiner* — Benjamin P Lee

(74) *Attorney, Agent, or Firm* — Cassan Maclean IP Agency Inc.

(57) ABSTRACT

A blast panel assembly includes a laminate formed of a plurality of glued together sheets of plywood mounted in a metal frame.

6 Claims, 3 Drawing Sheets

(56) References Cited

U.S. PATENT DOCUMENTS

| | | | | |
|---|---|---|---|---|
| 9,200,480 | B2 * | 12/2015 | Deiler | E05G 1/026 |
| 2005/0003147 | A1 * | 1/2005 | Torrey | B32B 21/13<br>428/114 |
| 2005/0123728 | A1 * | 6/2005 | Reichwein | B32B 3/02<br>428/192 |
| 2008/0092730 | A1 * | 4/2008 | Hall | E04H 9/10<br>89/36.04 |
| 2008/0092731 | A1 * | 4/2008 | Hall | B29C 70/086<br>89/36.04 |
| 2009/0173429 | A1 * | 7/2009 | Shimamura | A45C 5/02<br>156/91 |
| 2010/0326011 | A1 * | 12/2010 | Norling | B27D 1/04<br>52/796.1 |
| 2012/0186424 | A1 * | 7/2012 | Tunis | F41H 5/0492<br>89/36.02 |
| 2013/0233163 | A1 * | 9/2013 | Bergiadis | F41H 5/013<br>89/36.02 |
| 2014/0084132 | A1 * | 3/2014 | Ciuperca | E04G 9/04<br>249/1 |
| 2016/0061569 | A1 * | 3/2016 | Fernandez | F41H 5/04<br>89/36.02 |

* cited by examiner

BLAST PANEL ASSEMBLY

This invention relates to a blast resistant panel assembly.

Blast resistant panels are by no means new. One form of blast panel consists of heavy steel or iron panels. Other impact resistant panels are described in U.S. Pat. No. 6,119,422, issued to Theodore E. Clear et al on Sep. 19, 2000, U.S. Pat. No. 6,699,575, issued to Habil J. Dagher et al on Mar. 2, 2004, U.S. Pat. No. 7,406,806, issued to Gerald Hallissy et al on Aug. 5, 2008 and U.S. Pat. No. 8,596,018, issued to Habib J. Dagher et al on Dec. 3, 2013.

The panel described in the Bouhnini et al U.S. Pat. No. 6,119,422 includes layers of gypsum board bonded together with an adhesive mesh.

The Hallissy et al U.S. Pat. No. 7,406,806 describes blast resistant wall units including a layer of structural board, preferably gypsum board or masonry board, a layer of thermoset matrix resin impregnated glass fibers and a further layer of structural board.

The Dagher et al U.S. Pat. No. 6,699,574 discloses a wood sheathing panel incorporating strips of fiber reinforced polymer in the perimeter or corners of the panel. The strips cover an area of 5-50 percent of surface area of the panel.

The Dagher et al U.S. Pat. No. 8,596,018 discloses a blast panel comprising a wood member having a compression side and a tension side. The tension side of the wood number is coated with a layer of fiber reinforced, polymer.

The blast panels described in the above-listed patents would be expensive to manufacture, because they incorporate at least two materials, one of which is a polymer or plastic.

An object of the present invention is to provide a relatively simple blast panel, which is inexpensive and easy to produce.

In its simplest form, the invention relates to a blast panel comprising a plurality of sheets of plywood, which are laminated by gluing the sheets together. Preferably, the laminated sheets are mounted in a metal frame.

BRIEF DESCRIPTION OF THE DRAWINGS

The invention is described below with reference to the accompanying drawings, which illustrate a preferred embodiment of the invention, and wherein:

With reference to FIGS. 1 and 2, the basic elements of the blast panel assembly include a hollow rectangular frame indicated generally at 1, strips 2 of angle iron and a plurality of laminated sheets 3 of plywood.

Figure 1:
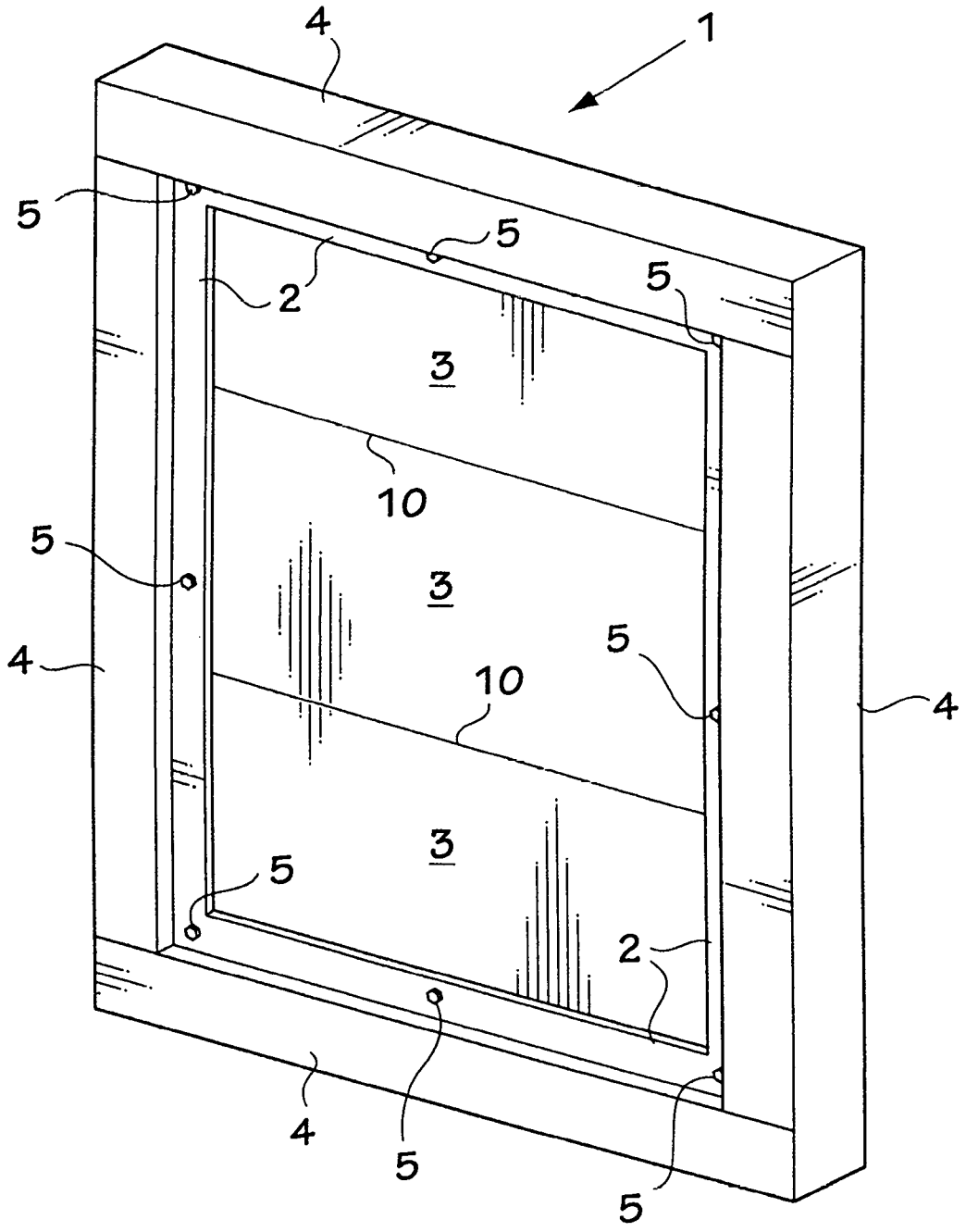
FIG. 1 is a schematic isometric view of the blast panel assembly as viewed from the rear and above.

The frame 1 is defined by four square cross section steel tubes 4 which are welded together to form a rectangle. The frame 1 need not be rectangular, it could be circular, triangular or any other shape. The strips 2 of angle iron are welded to the inner sides of the frame 1 and to each other, forming a rectangular bracket inside of the frame 1. The plywood sheets 3 are connected to the angle iron strips 2 by carriage bolts 5 extending through the angle iron strips 2 and the laminated plywood sheets 3, and nuts 6. The frame 1 can also be formed by U-shaped channel members (not shown).

Figure 2:
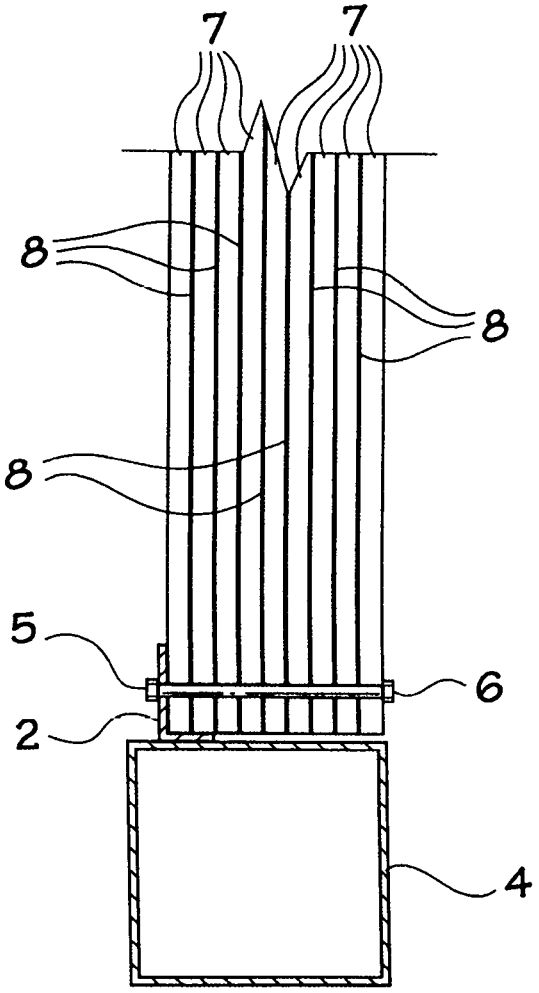
FIG. 2 is a schematic, cross-sectional view of a bottom portion of the blast panel of FIG. 1.
Figure 3:
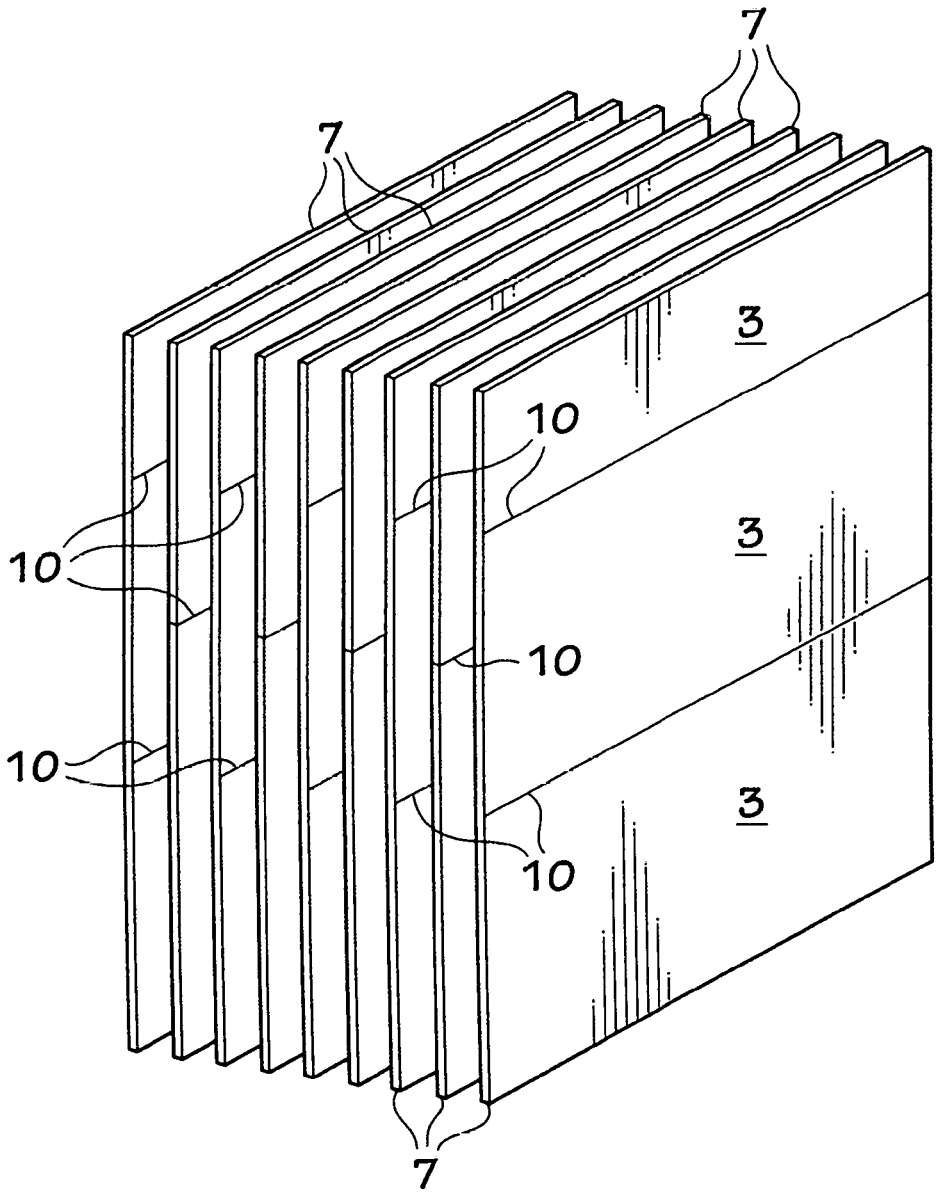
FIG. 3 is an exploded, isometric view of a plywood panel laminate used in the blast panel assembly of FIGS. 1 and 2.

As best shown in FIG. 2, the plywood sheets 3 are laminated by gluing them together with a continuous layer 8 of multi-purpose glue. A suitable glue is Lapage® multi-purpose glue. The sheets 3 are preferably three-quarter inch select grade plywood. The sheets 3 are laminated so that the joints 10 between the stacked sheets of one layer 7 are not aligned with the joints 10 between the next layer 7. As will be appreciated by a person skilled in the art to which the present invention relates, the sheets 3 can be stacked so that their long edges are horizontal, or the sheets can be arranged side by side with their long edges vertical so long as the abutting edges of the sheets forming one layer 7 are out of alignment with the abutting edges of the sheets in any adjacent layer 7. When using standard 4'×8' sheets of plywood, one of the sheets (in this case the top or bottom sheet) is cut in half lengthwise before laminated the sheets, and the arrangement of the sheets in the next layer 7 is reversed from top to bottom. Thus, alignment of the joints 10 between sheets 3 in adjacent layers 7 is avoided. With the arrangement of sheets 3 shown in FIG. 3, if one sheet of plywood is cut lengthwise in the middle, the result is two 2'×8' sheets which are used to form the top end of one layer 7 and the bottom end of an adjacent layer 7. The resulting laminate of sheets will have dimensions of approximately 10' in height and 8' in width.

Tests were conducted on a panel assembly in accordance with the invention including a laminate of nine layers of three-quarter inch plywood sheets. The laminated plywood sheets 3 had three-quarter inch bolt holes drilled at six inches apart along the vertical edges of the nine sheet 8'×8' laminate for mounting in steel framing elements.

Test loads were developed by detonating two batches of ammonium nitrate/fuel oil using bulk industrial explosive mixture. Each shot used a different explosive weight and standoff from the test specimen. Five pressure gauges were mounted on the steel plates on the front of the reaction structure surrounding the specimen. Two laser-based displacement readers were positioned along the vertical center line of the panel for each test. The ranges of gauge readings recorded for positive phase pressure and impulse are presented in Table 1.

TABLE 1

| Test Number | Pressure in psi (kPa) | Impulse in psi-ms (kPa-ms) |
|---|---|---|
| 1 | 33-35 (230-240) | 90-103 (620-710) |
| 2 | 25-28 (170-190) | 96-123 (660-850) |

The maximum displacement of the panel did not exceed 0.4 inch (10 mm) for either test within the first 150 ms of recorded responses. No permanent panel deformation was observed in either case during post-test inspection, i.e., the panel returned to its original pre-test position as a result of an elastic response. Accordingly, it is reasonable to expect that assemblies with a similar laminate thickness and span can likely sustain significantly higher blast loads than those tested without permanent deformation. The panels can potentially take even higher loads where permanent panel deformation is acceptable, e.g., where panels are to be subjected to a one-time blast event and only need to sustain capacity to allow for personnel egress.

The invention claimed is:

1. A blast panel assembly comprising a plurality of sheets of plywood glued together to form a laminate; a one-piece metal frame surrounding the laminate; a plurality of spaced apart bolts extending completely through the metal frame and the laminate; and nuts on said bolts securing the laminate to the frame.

2. The blast panel assembly of claim 1, wherein each layer of the laminate is formed by a plurality of sheets of plywood with abutting edges.

3. The blast panel assembly of claim 2, wherein the abutting edges of the sheets of plywood in one layer are out of alignment with the abutting edges of the sheets of plywood in any adjacent layer of the laminate.

4. The blast panel assembly of claim 3, wherein said frame includes square cross section metal tubing surrounding said sheets of plywood; and angle iron strips on an inner side of the tubing, said bolts extending through said strips and said plywood sheets for connecting the sheets to the angle iron strips.

5. The blast panel assembly of claim 3, wherein said frame includes metal channel members of U-shaped cross section for receiving said sheets of plywood, said bolts and nuts connecting said sheets of plywood to said metal channel members.

6. The blast panel assembly of claim 3, wherein the laminate includes nine layers of three-quarter inch select grade plywood, whereby the assembly is capable of withstanding blast loads of 25-35 psi and impulses of 90-123 psi-ms.

* * * * *